US008340303B2

(12) United States Patent
Chun

(10) Patent No.: US 8,340,303 B2
(45) Date of Patent: Dec. 25, 2012

(54) METHOD AND APPARATUS TO GENERATE SPATIAL STEREO SOUND

(75) Inventor: Ingyu Chun, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1420 days.

(21) Appl. No.: 11/500,287

(22) Filed: Aug. 8, 2006

(65) Prior Publication Data

US 2007/0092084 A1 Apr. 26, 2007

(30) Foreign Application Priority Data

Oct. 25, 2005 (KR) ..... 10-2005-0100938

(51) Int. Cl.
*H04R 5/00* (2006.01)

(52) U.S. Cl. ..... 381/17; 381/63; 381/27; 381/303; 381/310

(58) Field of Classification Search ..... 381/1, 17, 381/18, 300, 303, 307, 63, 27, 309, 310, 381/74
See application file for complete search history.

(56) References Cited

U.S. PATENT DOCUMENTS

| | | | | |
|---|---|---|---|---|
| 5,572,591 | A * | 11/1996 | Numazu et al. | 381/1 |
| 5,657,391 | A * | 8/1997 | Jyosako | 381/1 |
| 5,943,427 | A * | 8/1999 | Massie et al. | 381/17 |
| 2004/0136554 | A1 * | 7/2004 | Kirkeby | 381/309 |

FOREIGN PATENT DOCUMENTS

| | | |
|---|---|---|
| CN | 1190861 | 8/1998 |
| CN | 1494812 | 5/2004 |
| CN | 1600046 | 3/2005 |
| JP | 3557177 | 5/2004 |
| KR | 161901 | 8/1998 |
| KR | 2001-1415 | 1/2001 |

OTHER PUBLICATIONS

Chinese Office Action issued Jun. 5, 2009 in CN Application No. 2006101374430.

* cited by examiner

*Primary Examiner* — Vivian Chin
*Assistant Examiner* — Leshui Zhang
(74) *Attorney, Agent, or Firm* — Stanzione & Kim, LLP

(57) ABSTRACT

A method of processing a 2-channel stereo sound signal into a spatial stereo sound includes generating stereo signals of first and second channels from a first input channel signal and a second input channel signal by applying a time difference of times taken for each channel signal to arrive at two ears, and a sound pressure difference formed between the two ears and varying with respect to a frequency band or constant, to each of the first and second input channel signals, generating a center channel of the first and second channel by adding the first and second input channel signals, generating a surround signal of the first channel by subtracting one of the first and second input channel signals, from the other one of the first and second input channel signals, and generating a surround signal of the second channel by making the surround signal of the first channel out of phase, generating a plurality of reflected sounds from the generated surround signals, and applying the time difference and the sound pressure difference to each reflected sound, processing reflected signals of the first and second channels from the reflected sounds, and adding the generated signals of the first channel and adding the generated signals of the second channel.

34 Claims, 5 Drawing Sheets

METHOD AND APPARATUS TO GENERATE SPATIAL STEREO SOUND

CROSS-REFERENCE TO RELATED APPLICATIONS

This application claims priority under 35 U.S.C. §119(a) from Korean Patent Application No. 10-2005-0100938, filed on Oct. 25, 2005, in the Korean Intellectual Property Office, the disclosure of which is incorporated herein in its entirety by reference.

BACKGROUND OF THE INVENTION

1. Field of the Invention

The present general inventive concept relates to a stereo sound reproducing system, and more particularly, to a method and apparatus to generate a spatial stereo sound by processing a 2-channel stereo sound signal reproduced through a medium, such as a CD and MP3 into the spatial stereo sound.

2. Description of the Related Art

Recently, technologies enabling a 3-dimensional stereo sound through a 2-channel headphone, earphone, or speaker system have been implemented.

Also, in order to implement this stereo sound through the 2-channel earphone, headphone, or speaker system, stereo enhancement systems based on process coding audio information have been being developed.

A conventional stereo enhancement system is disclosed in U.S. Pat. No. 6,597,791.

Referring to FIG. 1, a conventional stereo enhancement system 10 receives left channel (L) and right channel (R) signals 12 and 14 and generates a stereo sound effect of two channels 60 and 62 by using a difference signal 34 and a sum signal 22 of left and right channels 18(24) and 20(26) using an adder 16 and a subtractor 32. That is, the stereo enhancement system 10 combines the left and right channel signals 18(24) and 20(26), the difference signal 34 and the sum signal 22 of the two channels to emphasize the stereo sound effect. At this time, the difference signal 34 is generated as a modified difference signal through a plurality of filters 44 and 48 and an attenuator 46 of an equalizer 40. The two channels 60 and 62 are generated using adders 58 and 56. The equalizer 40 receives an input through a terminal 42 and generates three signals 50, 52 and 54 to be transmitted to the adders 58 and 56.

However, since the conventional stereo enhancement system 10, as shown in FIG. 1, does not consider a head of a listener as an important role in recognizing a direction of a sound source, the positioning of a virtual sound source is not performed. Also, since reflected sounds are not generated, the conventional stereo enhancement system cannot provide a spatial feeling.

SUMMARY OF THE INVENTION

The present general inventive concept provides a method and apparatus to generate a spatial stereo sound, by providing a 2-channel stereo sound effect to a 2-channel stereo signal being reproduced through an MP3 player or a CD player so that a listener can feel a stereo feeling and spatial feeling.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a method of generating a spatial stereo sound, the method including generating stereo signals from a first input channel signal and a second input channel signal, the method by applying a time difference of times taken for each channel signal to arrive at two ears, and a sound pressure difference between the two ears, to each of the first and second input channel signals, generating a center channel of the first and second channel, by adding the first and second input channel signals, generating a surround signal of the first channel by subtracting the delayed second input channel signal from the first input channel signal, and generating a surround signal of the second channel by making the surround signal of the first channel out of phase, generating a plurality of reflected sounds from the generated surround signals of the first channel, and by applying the time difference and the sound pressure difference to each reflected sound to generate reflected signals of the first and second channels from the reflected sounds, and adding the generated signals of the first channel and adding the generated signals of the second channel.

The foregoing and/or other aspects of the present general inventive concept may be achieved by providing an apparatus to generate a spatial stereo sound, including a stereo signal generation unit to generate stereo signals from a first input channel signal and a second input channel signal by applying a time difference of times taken for each channel signal to arrive at two ears, and a sound pressure difference between the two ears, to each of the first and second input channel signals, a center channel signal generation unit to generate a center channel of the first and second channel, by adding the first and second input channel signals, a surround signal generation unit to generate a surround signal of the first channel by subtracting the delayed second input signal from the first input channel signal, and generating a surround signal of the second channel by making the surround signal of the first channel out of phase, a reflected sound processing unit to generate a plurality of reflected sounds from the surround signals generated in the surround signal generation unit, by applying the time difference and the sound pressure difference to each reflected sound, to generate reflected signals of the first and second channels into the reflected sounds, and a mixing unit to add the signals of the first channel generated in the stereo signal generation unit, the surround signal generation unit, and the reflected sound processing unit, and to add the generated signals of the second channel generated in the stereo signal generation unit, the surround signal generation unit, and the reflected sound processing unit.

The foregoing and/or other aspects of the present general inventive concept may be achieved by providing a computer readable recording medium containing computer readable codes to perform a method, the method comprising generating stereo signals of first and second channels from a first input channel signal and a second input channel signal by applying a time difference of times taken for each channel signal to arrive at two ears, and a sound pressure difference formed between the two ears, to each of the first and second input channel signals, generating a surround signal of the first channel by subtracting the delayed second input channel signal from the first input channel signal, and generating a surround signal of the second channel by making the first surround signal of the first channel signal out of phase, generating a plurality of reflected sounds from the generated surround signals by applying the time difference and the sound pressure difference to each reflected sound, and generating one or more reflected signals of the first and second channels from the reflected sounds, and adding the generated stereo, surround, and reflected signals of the first channel to output a fist channel signal and adding the generated stereo, surround, and reflected signals of the second channel to output a second channel signal.

The foregoing and/or other aspects of the present general inventive concept may be achieved by providing an apparatus to generate a spatial stereo sound, including a stereo signal generation unit to generate stereo signals of first and second channels from a first input channel signal and a second input channel signal, and to generate processed stereo signals of the first and second channels from the first stereo signals of the first and second channels according to a first time difference and a first sound pressure difference, a surround signal generation unit to process one of the first and second input channel signals according to a second time difference and a second sound pressure difference as a surround signal of the first channel, and to control a phase of the surround signal of the first channel to generate a second surround signal of the second channel, and a reflected sound processing unit to generate reflected signals of first and second channels according to a third time difference and a third sound pressure difference from the processed one of the first and second input channel signals, and a mixing unit to add the stereo, processed stereo, surround, and reflected signals of the first and second channels to generate a first channel signal and a second channel signal The foregoing and/or other aspects of the present general inventive concept may be achieved by providing a method of generating a spatial stereo sound, the method including generating stereo signals of first and second channels from a first input channel signal and a second input channel signal, generating processed stereo signals of the first and second channels from the first stereo signals of the first and second channels according to a first time difference and a first sound pressure difference, processing one of the first and second input channel signals according to a second time difference and a second sound pressure difference as a surround signal of the first channel, controlling a phase of the surround signal of the first channel to generate a second surround signal of the second channel, generating reflected signals of first and second channels according to a third time difference and a third sound pressure difference from the processed one of the first and second input channel signals, and adding the stereo, processed stereo, surround, and reflected signals of the first and second channels to generate a first channel signal and a second channel signal.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
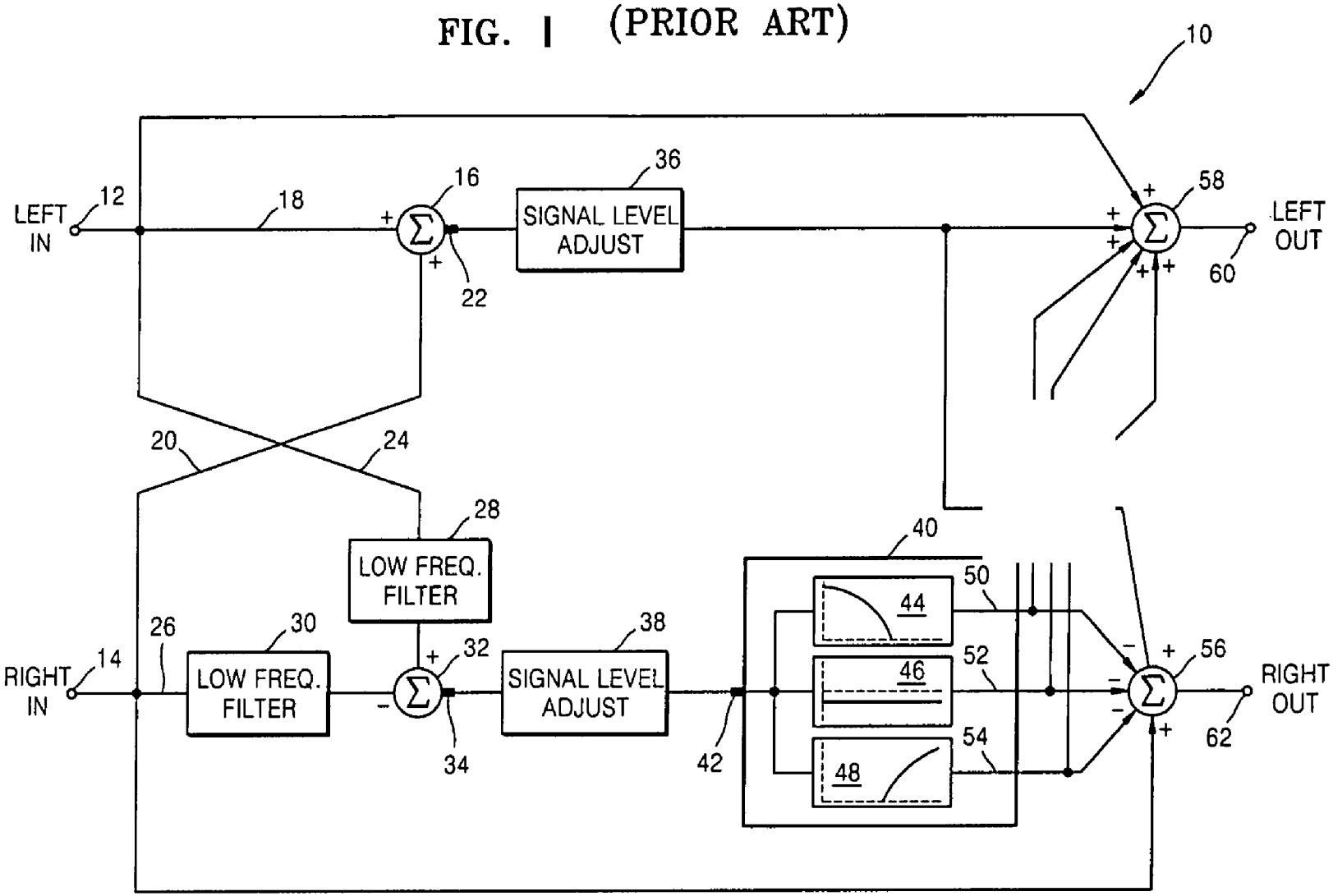
FIG. 1 (PRIOR ART)
FIG. 1 is a block diagram illustrating a conventional stereo enhancement system.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
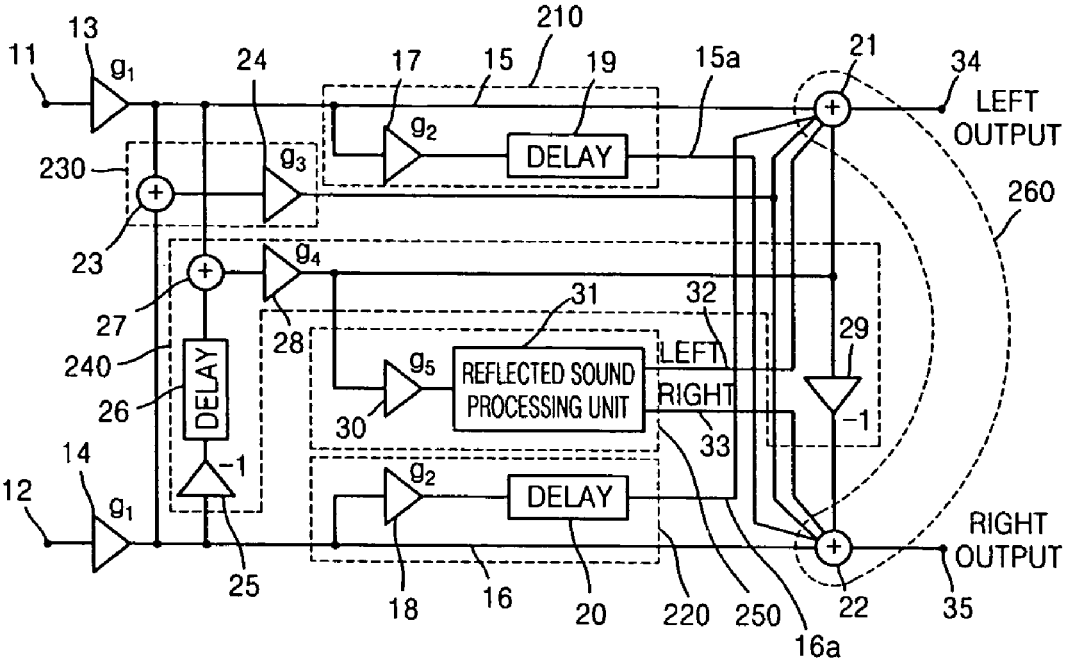
FIG. 2 is a block diagram illustrating an apparatus to generate a spatial stereo sound according to an embodiment of the present general inventive concept.

FIG. 2 is a block diagram illustrating an apparatus to generate a spatial stereo sound according to an embodiment of the present general inventive concept.

Referring to FIG. 2, the spatial stereo sound apparatus includes left and right stereo signal generation units 210 and 220, a center channel signal generation unit 230, a surround signal generation unit 240, a reflected sound processing unit 250, and a mixing unit 260.

The left and right stereo signal generation units 210 and 220 generate stereo signals 15*a* and 16*a* of first and second channels, by applying a time difference of times taken for each of left and right channel signals to arrive at two ears of a listener and a sound pressure difference, to input channel signals 11 and 12.

The center channel signal unit 230 generates a center channel signal by adding the input channel signals 11 and 12.

The surround signal generation unit 240 generates a surround signal of any one channel of the left and right channels, by subtracting the delayed other channel signal from the one channel, and generates a surround signal of the other channel, by making the generated surround signal out of phase.

The reflected sound processing unit 250 generates a plurality of reflected sounds (reflected sound signals) from the surround signal of the channel generated in the surround signal generation unit 240, and generates the reflected sounds 32 and 33 of left and right channels, by applying the time difference of times taken for each reflected sound to arrive at the two ears of the listener, and the sound pressure difference between the two ears, to each reflected sound.

The mixing unit 260 adds the left channels of the signals generated in the left and right stereo signal generation unit 210 and 220, the center channel signal generation unit 230, the surround signal generation unit 240, and the reflected sound processing unit 250, and adds the right channels of the generated signals, and adds the left channels of the generated signals, and then outputs left and right channel spatial stereo signals.

First, the input channel signals 11 and 12 generated from a sound source reproducing apparatus (not shown), such as an MP3 player and a CD player, are input as left and right stereo input channel signals. At this time, if the input channel signals 11 and 12 are input as a mono channel, an effect giving a spatial feeling is lowered. First multipliers 13 and 14 adjust a level of the input channel signals 11 and 12 input to the left and right channels with a gain value ($g_1$) to generate level-adjusted channel signals 15 and 16. At this time, the gain value ($g_1$) of the first multipliers 13 and 14 may be a positive value equal to or less than 1 in order to secure a headroom and is applied to the left and right channel signals identically.

Figure 4:
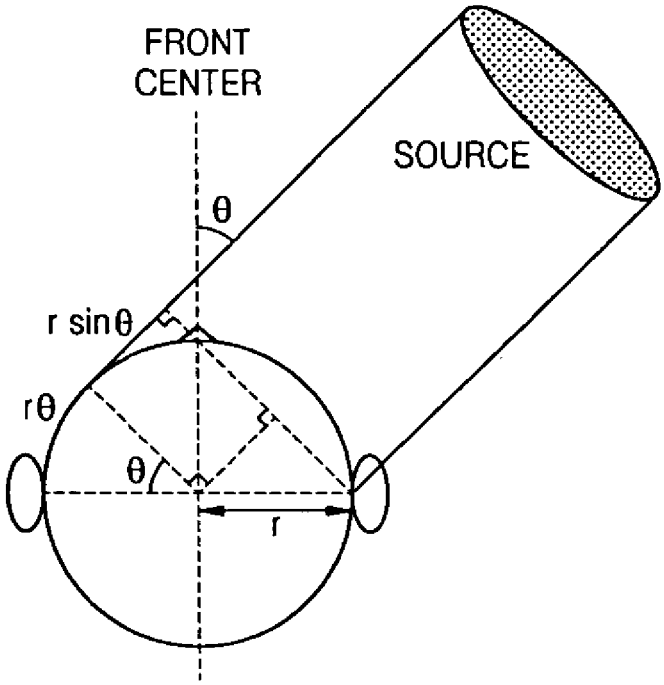
FIG. 4 is a conceptual diagram illustrating a time difference between two ears.

A relative direction of a sound source from a listener can be perceived from the sound pressure difference of signals incident on the two ears. Representative perception methods of the direction of the sound source are an interaural time difference (ITD) and an interaural level difference (ILD). The ITD indicates the time difference of signals transferred to the two ears of the listener caused by a length difference of paths from the sound source to the two ears as shown in FIG. 4. The ITD can be expressed as the following equation 1:

$$ITD=r(\theta+\sin\theta)/C_0 \quad (1)$$

where $C_0$ denotes a velocity of sound and is about 344 m/s in air, θ denotes an angle between a sound source and a front center of a listener, and r denotes a radius of a shape of the listener 430 having ears 43.

The ITD can be effectively perceived in a low frequency band equal to or less than about 700 Hz.

Meanwhile, the ILD indicates an amplitude difference or level difference of signals transferred to the two ears of the listener. The ILD is caused by diffusion of sound occurring mainly in the head and ears.

Accordingly, by using the ITD and ILD, the positioning of a sound source can be implemented. That is, the ITD can be implemented by a delay value and the ILD can be by adjusting a gain.

Generally, when a user listens a stereo sound signal using a headphone or earphone, a sound image is formed inside the head or two ears. If the sound image is moved so that the sound image is felt as if the sound comes from two speakers, then the listener can feel a stereo feeling. Accordingly, the present embodiment the sound images of the left and right channel signals by using the ITD and ILD may move the left channel signal (level-adjusted input channel signal) 15 output from the first multiplier 13 arrives at the left ear of the left sound image. This left channel signal 15 arrives at the right ear of the left sound image through a second multiplier 17 having a gain value ($g_2$) and a delay filter 19 having a predetermined delay coefficient. Likewise, the right channel signal (level-adjusted input channel signal) 16 output from the first multiplier 14 arrives at the right ear of the right sound image. This right channel signal 16 arrives at the left ear of the right sound image through a second multiplier 18 having a gain value ($g_2$) and a delay filter 20 having a predetermined delay coefficient. Here, the delay filters 19 and 20 perform ITD operations and the second multipliers 17 and 18 perform ILD operations. Here, the ILD does not consider the difference of frequency components, such as a head related transfer function (HRTF), and instead, applies the gain value ($g_2$).

In order to maintain the quality of the left and right channel signals to the maximum, the signals 15 and 16 of the close ears of the left and right channel sound images are output without change, and the signals (15*a* and 16*a*) of the distant ears are delayed for an ITD amount and reduced by an ILD level and then output. By doing so, with a small amount of computation, the stereo feeling is provided. However, in order to provide a more accurate stereo feeling, the second multipliers 17 and 18 can be replaced by ILD filters, such as HRTF or low pass filters, to which the ILD considering the difference of frequency components is applied.

The signal 15 to arrive at the left ear and the signal output from the delay filter 20 are added in a left first adder 21. Likewise, the signal 16 to arrive at the right ear and the signal output from the delay filter 19 are added in a right first adder 22.

Also, by generating the center channel signal and surround channel signals, the present embodiment provides an effect giving a feeling of being surrounded by sounds.

That is, the left and right channel signals 15 and 16 are added in a second adder 23 and generated as the center channel signal. A third multiplier 24 multiplies the level of the center channel signal by a gain value ($g_3$). Accordingly, the center channel signal is level adjusted through the third multiplier 24, and then output to the left and right first adders 21 and 22. Also, a third adder 27 adds the right channel signal 16 output through a multiplier 25 having a gain value of −1 and a delay filter 26, to the left channel signal 15 and generates the surround channel signal (or single channel surround sound). Here, the delay filter 26 plays a role of lowering a correlation between left and right channel signals. Accordingly, the surround signal is level adjusted in a fourth multiplier 28 and then, output to the left first adder 21. Also, the surround signal is made to be 180° out of phase through a multiplier 29 having a gain value of −1, and then output to the right first adder 22. That is, by adding the left and right surround channels made to be 180° out of phase, to the left and right output signals, the stereo feeling is more intensified.

Meanwhile, in order to avoid in-head localization that is liable to happen when sound is reproduced through a headphone or earphone, and to make a listener feel as if the sound image is localized outside the head, a virtual room should be designed to reproduce multiple reflected sounds.

The single channel surround signal output from the fourth multiplier 28 is level adjusted through a fifth multiplier 30 and input to a reflected sound processing unit 31. The reflected sound processing unit 31 generates a plurality of reflected sounds from the single channel surround signal, and separates the reflected sounds into left channel and right channel reflected sound signals 32 and 33, by applying an ITD and ILD. Accordingly, the left channel reflected sound signal 32 is output to the left first adder 21 and the right channel reflected sound signal 33 is output to the right first adder 22.

As a result, the first adders 21 and 22 add the left channel signals and the right channel signals, respectively, output from the first multipliers 13 and 14, the delay filters 19 and 20, the third multiplier 24, the fourth multiplier 28, and the sub-sound processing unit 31.

The final left and right channel output signals of the spatial stereo are the signal 34 output from the left first adder 21 and the signal 35 output from the right first adder 22. Accordingly, the final left and right channel signals may be output to a 2-channel headphone or earphone through an amplifier, or if the gain values of the multipliers are appropriately adjusted, may be output to 2-channel speakers.

Figure 3:
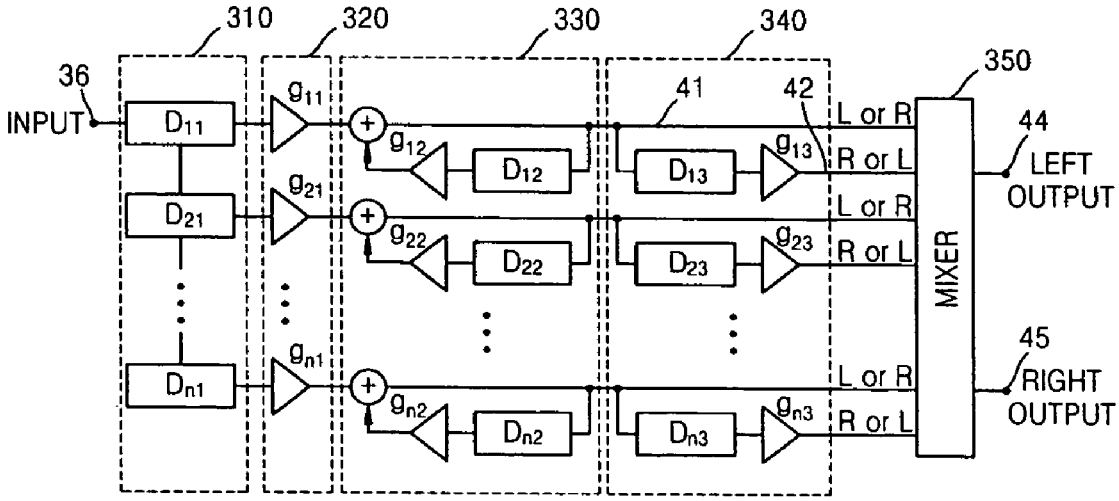
FIG. 3 is a detailed diagram illustrating a reflected sound processing unit of the apparatus of FIG. 2.

FIG. 3 is a detailed diagram of the reflected sound processing unit 31 of the apparatus of FIG. 2 according to an embodiment of the present invention.

First, in a headphone reproducing system, if a stereo sound is not accurately reproduced or not provided, an in-head localization phenomenon that a sound image is formed inside the head of the listener is liable to occur. Accordingly, by adding reflected sounds generated in a virtual room to the reproduced sound of the headphone, the in-head localization phenomenon can be removed and the sound image can be made to be formed at a desired location outside the head of the listener.

Figure 5:
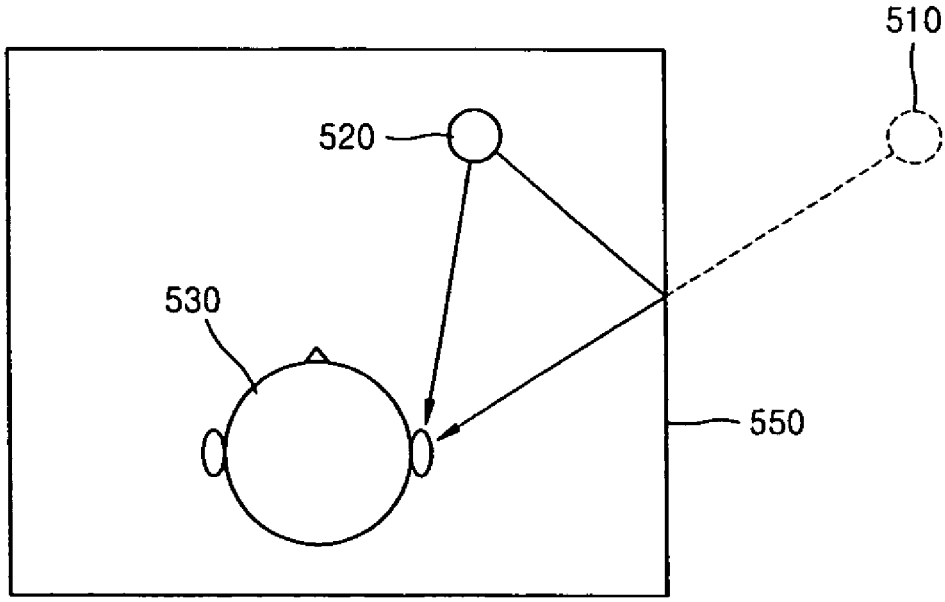
FIG. 5 is a conceptual diagram illustrating a method of generating a reflected sound in a virtual room according to an embodiment of the present general inventive concept.

A reflected sound can be implemented by a simple structure model of a room. FIG. 5 is a view illustrating one of mirror image sources of one sound source 520 in a given virtual room 550. A mirror image sound source 510 is a virtual sound source generated by the reflection of the sound source 520 with a surface of a virtual wall as an axis of symmetry thereof. A delay time of the reflected sound taken to travel from the sound source 520 to the ears of a listener 530 can be replaced by the delay time taken to travel a straight line distance from the mirror image sound source 510 to ears of the listener 530. Also, strength of the reflected sound can be calculated from strength of the mirror image sound source depending on the degree of sound absorption of the wall surface. Virtual sound sources as well as an original sound source are generated again as infinite number of new sound sources by the reflected sounds by the wall surface of the virtual room. Among the infinite number of virtual sound sources, a finite number of sound sources are set at an appropriate level. Then, the delay time and strength of each virtual sound source are calculated. Then, the ITD and ILD of each virtual sound source are calculated with respect to an incident angle on the listener. Each parameter to be calculated varies depending on a shape of a given room, a boundary condition, and positions of the listener and the sound source. Accordingly, in order to generate effective reflected sounds, a virtual room should be designed appropriately.

The reflected sound processing unit 31 is a filter unit to output stereo sound signals heard by the left and right ears in 2 channels, by applying a stereo feeling occurred by the head of the listener and a spatial feeling with respect to the virtual room, to one input signal of each channel. According to the position of a virtual speaker, and the shape and condition of the virtual room, the reflected sound processing unit 31 generates different reflected sounds. If virtual speakers in the virtual room with predetermined shapes and boundary conditions are positioned and the listener is positioned at an optimized location, the reflected sounds reflected by the virtual wall surface of the virtual room, as well as direct sounds directly delivered to the listener from the virtual speakers, can be delivered to the listener. Each of reflected sounds and the direct sound has a different delay time, a different sound pressure amount, and a different incident angle on the listener.

The reflected sound processing unit 31 of FIG. 3 includes a delay filter unit 310, a multiplication unit 320, a feedback comb filter unit 330, an ITD & ILD filter unit 340, and a mixer unit 350.

First, in a virtual room having a predetermined shape and boundary condition, a virtual speaker with a predetermined position is disposed and each of filter coefficients (for example, a time delay coefficient[,] and a gain value) are set in advance. Accordingly, in order to provide an appropriate spatial feeling and stereo feeling, the virtual room should be designed appropriately.

The delay filter unit 310 generates a plurality of reflected sounds by delaying one channel input signal according to a plurality of time delay coefficients ($d_{11}$, $d_{21}$, . . . , $d_{n1}$). The delay times ($d_{11}$, $d_{21}$, . . . , $d_{n1}$) to generate a plurality of reflected sounds implement reflected sounds sequentially traveling from a number of mirror image sound sources (1, 2, . . . n) generated from the virtual speaker positioned in the virtual room, to the listener, and are set as values different to each other with respect to a size of the virtual room.

The multiplication unit 320 multiplies the reflected sounds delayed in the delay filter unit 310 by predetermined different gain values ($g_{11}$, $g_{21}$, . . . , $g_{n1}$), respectively. Here, the gain values ($g_{11}$, $g_{21}$, . . . , $g_{n1}$) with respect to the n reflected sounds are in proportion to relative sound pressure amounts of the n sounds, respectively, and are set as different values with respect to the degree of sound absorption of the virtual room.

The feedback comb filter unit 330 continuously generates reflected sounds from each of the reflected sounds multiplied in the multiplication unit 320, through a feedback loop to which a plurality of different time delay coefficients ($d_{12}$, $d_{22}$, . . . , $d_{n2}$) and gain values ($g_{12}$, $g_{22}$, . . . , $g_{n2}$) are applied. That is, one feedback comb filter continuously generates a plurality of reflected sounds delayed and gain-adjusted through a feedback loop in relation to one reflected sound. At this time, the time delay values ($d_{12}$, $d_{22}$, . . . , $d_{n2}$) and the gain values ($g_{12}$, $g_{22}$, . . . , $g_{n2}$) are set as different values with respect to the size and degree of sound absorption of the virtual room. Also, the absolute value of each of the gain values ($g_{12}$, $g_{22}$, . . . , $g_{n2}$) is less than 1.

The ITD & ILD filter unit 340 separates each of the reflected sound generated in the feedback comb filter unit 330 into left and right channel signals, by applying a time difference of times taken for each reflected sound to arrive at the two ears, and a sound pressure difference between the two ears. That is, each of the reflected sounds generated in the feedback comb filter unit 330 is input to the left and right through the ITD & ILD filter unit 340 to move a sound image. Then, only one signal of the left and right signals is transferred through delay filters and multipliers applying ILDs and ITDs. The delay filters and multipliers have time delay values ($d_{13}$, $d_{23}$, . . . , $d_{n3}$) and gain values ($g_{13}$, $g_{23}$, . . . , $g_{n3}$), respectively. The multipliers can be replaced by ILD filters. That is, in order to provide a more accurate stereo feeling, the multipliers can be replaced by ILD filters, such as HRTF or low pass filters, to which the ILD considering a difference of frequency components is applied.

If the sound image of a signal 41 output from the feedback comb filter 330 is on a left hand side, the signal 41 is the left channel signal, and the signal 42 output through the delay filters and multipliers is the right channel signal. Also, if the sound image of the signal 41 output from the feedback comb filter 330 is on a right hand side, the signal 41 is the right channel signal, and the signal 42 output through the delay filters and multipliers is the left channel signal.

At this time, the time delay values ($d_{13}$, $d_{23}$, . . . , $d_{n3}$) and the gain values ($g_{13}$, $g_{23}$, . . . , $g_{n3}$) applied to the delay filters and multipliers, respectively, implement the time differences and level differences of the respective reflected sounds arriving at the two ears of the listener, and are set with respect to the incident angles of the sounds. If the reflected sounds have a plurality of different incident angles, respectively, a sound effect with a stereo feeling and spatial feeling can be generated.

The mixer unit 350 adds the left channels of the signals separated into left channels (L) and right channels (R) in the ITD & ILD filter unit 340, and adds the right channels of the signals. That is, a left adder (not shown) adds the left channel signals among left channel signals and right channel signals output from the ITD & ILD filter unit 340, and a right adder (not shown) adds the right channel signals. Finally, the mixer unit 350 outputs left channel reflected sound signal 44 and the right channel reflected sound signal 45.

Each of the filter coefficients is appropriately set by positioning a virtual speaker at a predetermined location in a virtual room having a predetermined shape and boundary condition. Accordingly, in order to provide an appropriate stereo feeling and spatial feeling, the virtual room should be designed appropriately.

Figure 6:
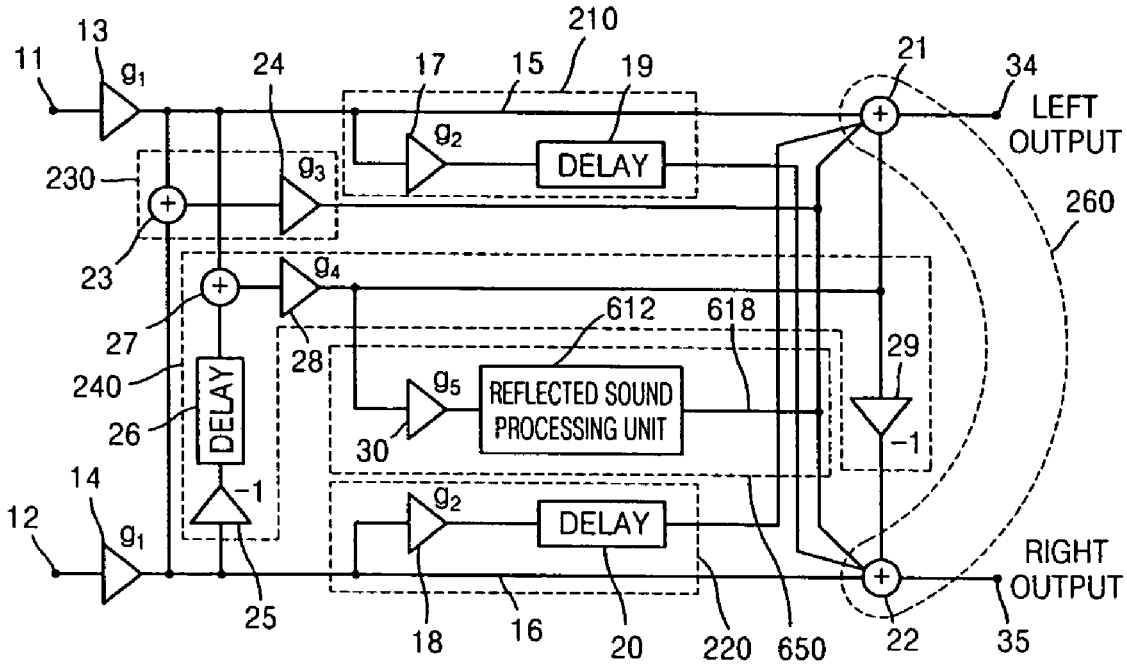
FIG. 6 is a block diagram illustrating an apparatus to generate a spatial stereo sound according to another embodiment of the present general inventive concept.

FIG. 6 is a block diagram illustrating an apparatus to generate a spatial stereo sound according to another embodiment of the present general inventive concept.

In the stereo sound generation apparatus of FIG. 6, only a reflected sound processing unit 650 is designed differently from that of the apparatus of FIG. 2 and other blocks or components may be the same as in FIG. 2. That is, the surround signal output from the fourth multiplier 28 is level adjusted through the fifth multiplier 30 having a gain value ($g_5$) and input to a reflected sound generation unit 612. The reflected sound generation unit 612 generates one-channel reflected sound signal 618 from the surround signal (or level-adjusted surround signal) and outputs the signal 618 as left and right channel surround signals to the left first adder 21 and the right first adder 22.

Figure 7:
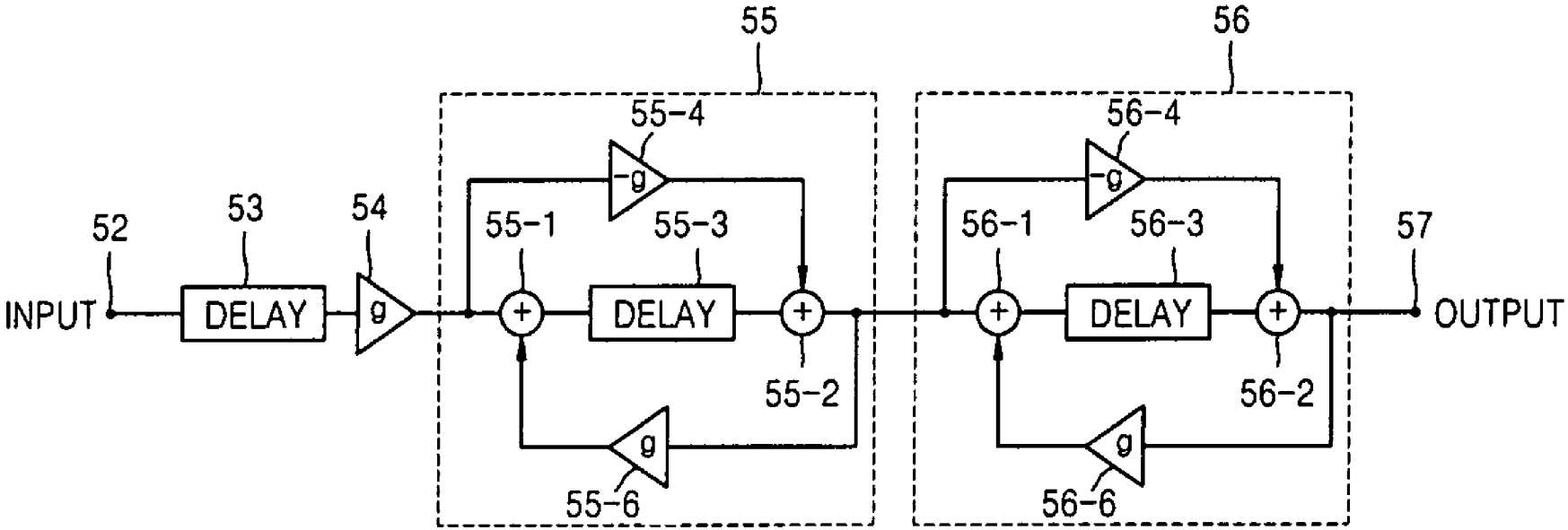
FIG. 7 is a detailed diagram illustrating a reflected sound processing unit of the apparatus of FIG. 6 according to an embodiment of the present general inventive concept.

FIG. 7 is a detailed diagram illustrating the reflected sound processing unit 612 of the apparatus FIG. 6 according to an embodiment of the present general inventive concept.

The reflected sound processing unit 612 of FIG. 7 is a filter unit to output a one-channel stereo sound signal given a spatial feeling, from one channel signal.

A delay filter 53 generates a reflected sound, by delaying a signal 52 input as one channel, according to a time delay coefficient. The signal 52 may be the surround signal generated from the surround signal generation unit 240 of FIG. 2 of FIG. 6.

A multiplier 54 has a predetermined gain value (g) set with respect to the degree of sound absorption of a virtual room, and adjusts the gain of the signal, by multiplying the signal delayed in the delay filter 53, by the gain value. Accordingly, the input signal 52 is generated as one gain-adjusted reflected signal through the delay filter 53 and the multiplier 54.

All-pass filters 55 and 56 have different delay coefficients and gain values, and are connected in series. The all-pass filters 55 and 56 generate a plurality of reflected sounds by all pass filtering one reflected sound.

That is, in the all-pass filters 55 and 56, where the input and output ends of delays 55-3 and 56-3 are connected to adders 55-1, 55-2, 56-1, and 56-2, input signals are fed forward to the first adders 55-2 and 56-2 through multipliers 55-4 and 56-4 having an attenuation coefficient (−g), and at the same time, the added outputs of the first adders 55-2 and 56-2 are fed back to the second adders 55-1 and 56-1 through multipliers 55-6 and 56-6 having an attenuation coefficient (g). Also, in the all-pass filters 55 and 56, the time delay coefficients are set with respect to the size of the virtual room and the gain values are set with respect to the degree of sound absorption of the virtual room.

Accordingly, a one-channel surround signal is output as a signal including a plurality of reflected sounds through the delay filter 53, the multiplier 54, and the all-pass filters 55 and 56.

Each of the filter coefficients is appropriately set by positioning a virtual speaker and a microphone at a predetermined location in a virtual room having a predetermined shape and boundary condition.

The present general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

According to the present embodiment as described above, the listener can feel a stereo sound from a 2-channel stereo sound. The present general inventive concept provides a stereo feeling by positioning a plurality of virtual sound sources, and provides a spatial feeling by generating reflected sounds.

Also, while a conventional technology uses an HRTF such that a tone changes and an amount of computation increases, the present general inventive concept does not use the HRTF and implements the spatial sound only through delaying and gain adjusting. Accordingly, the tone rarely changes and the amount of computation is small. For example, if the present general inventive concept is applied to a CD player or an MP3 player and a listener listens to music to which the present invention is applied, through a 2-channel headphone or earphone, the listener can feel a stereo feeling and spatial feeling with almost no change in tone such that the listening can become more entertaining and convenient.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of generating a spatial stereo sound, the method comprising:

generating a level-adjusted first channel signal and a level-adjusted second channel signal by adjusting respectively a first input channel signal and second input channel signal with a gain value with a level adjustment device;

generating stereo signals of the level-adjusted first and second channels from the first input channel signal and the second input channel signal by applying a time difference of times taken for each channel signal to arrive at two ears, and a sound pressure difference formed between the two ears, to each of the first and second input channel signals with a stereo signal generation device;

generating a first surround signal of the first channel by subtracting the second input channel signal that is delayed from the first input channel signal, and generating a second surround signal of the second channel by making the surround signal of the first channel out of phase with a surround signal generation device;

generating and outputting a plurality of reflected sounds from the generated surround signal of the first or the second channel based on different delays and different gains, and generating one or more reflected signals of the first and second channels for each of the generated reflected sounds by applying the time difference and the sound pressure difference between the two ears to each reflected sound with a reflected sound processing device; and adding the generated stereo, surround, and reflected signals of the first channel to generate and output a first channel signal of the spatial stereo sound with a mixing device, and adding the generated stereo, surround, and reflected signals of the second channel to generate and output a second channel signal of the spatial stereo sound with the mixing device, wherein the generating of the first and second channel signals comprises generating the first and second channel signals by applying a different time delay coefficient having an interaural time difference with respect to different incident angles of each of the reflected sounds.

2. The method of claim 1, further comprising:

generating a center channel signal with a center channel signal generation device by adding the first and second input channel signals, wherein the center channel signal is added to the first channel signal and the second channel signal.

3. The method of claim 1, wherein the generating of the stereo signals with the stereo signal generation device comprises outputting the first channel signal processed through a filter device having a frequency response of an interaural sound pressure difference of the sound pressure difference formed between the two ears and a delay of an interaural time difference of the time difference between the two ears from the second input channel signal, and the second channel signal processed through the filter device having a frequency response to the interaural sound pressure difference and a delay of the interaural time difference between the two ears from the first input channel signal.

4. The method of claim 1, wherein the generating of the stereo signals with a stereo signal generation device comprises outputting the first channel signal attenuated and delayed from the second input channel signal, and outputting the second channel signal attenuated and delayed from the first input channel signal.

5. The method of claim 1, wherein the generating of the first surround signal with the surround signal generation device comprises outputting a signal obtained by subtracting the delayed second input channel signal from the first input channel signal as the first surround signal of the first channel, and outputting a signal obtained by subtracting the first channel signal from the delayed second channel signal as the second surround signal of the second channel.

6. The method of claim 1, wherein the generating and outputting the plurality of reflected sounds with the reflected sound processing device comprises:

generating the plurality of reflected sounds by delaying the one-channel surround signal according to a plurality of time delay coefficients with a delay filter device;

multiplying the delayed reflected sounds by predetermined different gain values, respectively with a multiplier device;

continuously generating additional reflected sounds through a feedback loop from each of the multiplied reflected sounds by applying a plurality of different time delays and gains with a feedback comb filter device;

generating the first and second channel signals from the generated additional reflected sounds by applying the time difference and the sound pressure difference between the two ears to each of the additional reflected sounds with a sound image moving filter; and adding the generated additional reflected signals of the first channel to the first channel, and adding the generated additional reflected signals of the second channel to the second channel with a mixer device.

7. The method of claim 6, wherein the generating and outputting the plurality of reflected sounds with the reflected sound processing device comprises generating the plurality of reflected sounds using a plurality of different time delay coefficients given with respect to a size of a virtual room.

8. The method of claim 6, wherein the multiplying of the delayed reflected sounds with the multiplier device comprises multiplying the plurality of reflected sounds by different gain values, respectively, with respect to a degree of sound absorption of a virtual room.

9. The method of claim 6, wherein the generating of the additional reflected sounds in the feedback loop with the feedback comb filter comprises generating the additional reflected sounds according to a plurality of different time delay coefficients with respect to a size of a virtual room, and a plurality of different gain values with respect to the degree of sound absorption of the virtual room.

10. The method of claim 6, wherein the generating the first and second channel signals with the sound image moving filter comprises generating the first and second channel signals by applying a different gain coefficient having an interaural sound pressure difference with respect to different incident angles of each of the reflected sounds.

11. The method of claim 6, wherein the generating the first and second channel signals with the sound image moving filter comprises generating the first and second channel signals processed through the filters having a frequency response of an interaural sound pressure difference with respect to different incident angles of each of the reflected sounds.

12. A method of generating a spatial stereo sound, the method comprising:

generating stereo signals of first and second channels from a first input channel signal and a second input channel signal, by applying a time difference of times taken for each channel signal to arrive at two ears, and a sound pressure difference formed between the two ears, to each of the first and second input channel signals with a stereo signal generation device;

generating a center channel of the first and second channels by adding the first and second input channel signals with a center channel signal generation device;

generating a first surround signal of the first channel by subtracting the second input channel signal that is delayed from the first input channel signal, and generating a second surround signal of the second channel by making the surround signal of the first channel out of phase with a surround signal generation device;

generating a plurality of reflected sounds from the generated first surround signal of the first channel or the generated second surround signal of the second channel based on different delays and different gains with a reflected sound processing device;

generating a reflected signal of the first channel and a reflected signal of the second channel for each of the plurality of reflected sounds with the reflected sound processing device; and adding all the first channels of the generated stereo signals, generated surround signals, and generated reflected signals, and adding all the second channels of the generated stereo signals, the generated surround signals, and the generated reflected signals to generate and output the spatial stereo sound with a mixing device, wherein the generating of the spatial stereo sound of the first and second channels comprises applying a different time delay coefficient having an interaural time difference with respect to different incident angles of each of the reflected sounds.

13. The method of claim 12, wherein the generating of the reflected sounds with reflected sound processing device comprises:

generating a first reflected sound by delaying the one channel surround signal with respect to a time delay coefficient with a delay filter device;

multiplying the delayed reflected sound by a predetermined gain value with a multiplier device; and continuously generating additional reflected sounds from the multiplied reflected sound through a plurality of all-pass filter devices having different time delay coefficients and different gain values and connected in series.

14. The method of claim 13, wherein the generating of the first reflected sound with the delay filter device comprises generating the first reflected sound according to a time delay coefficient with respect to a size of a virtual room.

15. The method of claim 13, wherein the multiplying of the delayed reflected sound with the multiplier device comprises multiplying the delayed reflected sound by a gain value with respect to a degree of sound absorption of a virtual room.

16. The method of claim 13, wherein the generating of the additional reflected sounds through the all-pass filter devices comprises generating the additional reflected sounds according to a time delay coefficient with respect to a size of a virtual room and a gain value with respect to a degree of sound absorption of the virtual room.

17. An apparatus to generate a spatial stereo sound, comprising:

a stereo signal generation device to generate stereo signals of first and second channels from a first input channel signal and a second input channel signal, by applying a time difference of times taken for each channel signal to arrive at two ears, and a sound pressure difference formed between the two ears, to each of the first and second input channel signals;

a center channel signal generation device to generate a center channel signal of the first and second channel, by adding the first and second input channel signals;

a surround signal generation device to generate a first surround signal of the first channel by subtracting the second input channel signal that is delayed from the first input channel signal, and to generate a second surround signal of the second channel by making the surround signal of the first channel out of phase;

a reflected sound processing device to generate a plurality of reflected sounds from the first and second surround signals generated in the surround signal generation device based on different delays and different gains, and by applying the time difference of times taken for each channel signal to arrive at the two ears and the sound pressure difference formed between the ears to each of the plurality of reflected sounds, and to generate the reflected signals of the first and second channels for each of the reflected sounds; and a mixing device to add the generated stereo signals of the first channel generated in the stereo signal generation device, the generated center channel signal of the first channel in the surround signal generation device, and the generated plurality of reflected sounds of the first channel in the reflected sound processing device from the first surround signals, and adding the generated stereo signals of the second channel generated in the stereo signal generation device, the generated center channel signal of the second channel in the surround signal generation device, and the generated plurality of reflected sounds of the second channel in the reflected sound processing device from the second surround signals to generate and output the spatial stereo sound, wherein the generating of the spatial stereo sound of the first and second channels comprises applying a different time delay coefficient having an interaural time difference with respect to different incident angles of each of the reflected sounds.

18. The apparatus of claim 17, wherein the stereo signal generation device comprises:

a filter device having an interaural level difference of the two ears varying with respect to a frequency or a constant; and a filter device having an interaural time difference of the two ears.

19. The apparatus of claim 17, wherein the surround signal generation device comprises:

a first multiplier device to multiply one of the first input channel signal and the second input channel signal by a gain value of −1;

a delay filter device to delay the signal made to be out of phase in the first multiplier device, for a predetermined time;

an adder device to add the delayed signal and the other one of the first input channel signal and the second input channel signal to form an adder output signal;

a second multiplier device to adjust a level of the signal output from the adder and to output a second multiplier output signal; and a third multiplier device to multiply the second multiplier output signal by a gain value of −1.

20. The apparatus of claim 17, wherein the reflected sound processing device comprises:

a delay filter device to generate the plurality of reflected sounds by delaying the one-channel surround signal according to a plurality of different time delay coefficients set in a virtual room;

a multiplication device to multiply the reflected sounds delayed in the delay filter device, by predetermined different gain values, respectively, measured in the virtual room;

a feedback comb filter device to generate additional reflected sounds from each of the reflected sounds multiplied in the multiplication device, through a feedback loop to which a plurality of different time delays and gains measured in a virtual room are applied;

a sound image moving filter device to separate each of the additional reflected sounds generated in the feedback comb filter device and to output separated reflected signals, according to the time difference of times taken for the reflected sound to arrive at the two ears, and the sound pressure difference between the two ears; and a mixer device to add the separated reflected signals to the first channel and the second channel.

21. The apparatus of claim 17, wherein the reflected sound processing device comprises:

a delay filter device to generate a reflected sound by delaying one channel signal with respect to a time delay coefficient;

a multiplier device to multiply the reflected sound delayed in the delay filter device, by a predetermined gain value; and an all-pass filter device to output a signal having a plurality of reflected sounds from the reflected sound multiplied in the multiplication device, through a plurality of all-pass filters arranged in series and having different time delay coefficients and different gain values.

22. A stereo sound reproducing system comprising:

at least one input device to receive an audio source as a first input channel signal and a second input channel signal;

a spatial stereo sound generating apparatus to generate stereo signals of first and second channels from the first and second input channel signals input from a source generating apparatus, by applying a time difference of times taken for each channel signal to arrive at two ears, and a sound pressure difference formed between the two ears, to each of the first and second input channel signals, the spatial stereo sound generating apparatus including:

a first device to generate a first surround signal of the first channel by subtracting the second input channel signal that is delayed from the first input channel signal, and to generate a second surround signal of the second channel by making the surround signal of the first channel out of phase, a second device to generate a plurality of reflected sounds from the generated surround signals based on different delays and different gains by applying the time difference and the sound pressure difference formed between the two ears to each reflected sound, and to generate reflected signals of the first and second channels for each of the reflected sounds, and an adder device to add the generated stereo signals, the generated surround signal, and the generated reflected signals of the first channel, and to add the generated stereo signals, the generated surround signal, and the generated reflected signals of the second channel to generate and to output first and second added signals of the spatial stereo sound generating apparatus to be amplified, wherein the first and second channel signals are generated by applying a different time delay coefficient having an interaural time difference with respect to different incident angles of each of the reflected sounds.

23. A non-transitory computer readable recording medium containing computer readable codes to perform a method, the method comprising:

generating stereo signals of first and second channels from a first input channel signal and a second input channel signal by applying a time difference of times taken for each channel signal to arrive at two ears, and a sound pressure difference formed between the two ears, to each of the first and second input channel signals with a stereo signal generation device;

generating a first surround signal of the first channel by subtracting the second input channel signal that is delayed from the first input channel signal, and generating a second surround signal of the second channel by making the first surround signal of the first channel signal out of phase with a surround signal generation device;

generating and outputting a plurality of reflected sounds from the generated surround signals based on different delays and different gains by applying the time difference and the sound pressure difference to each reflected sound, and generating one or more reflected signals of the first and second channels for each of the reflected sounds with a reflected sound processing device; and adding the generated stereo, surround, and reflected signals of the first channel to generate and output a first channel signal of a spatial stereo sound with a mixing device, and adding the generated stereo, surround, and reflected signals of the second channel to generate and output a second channel signal of the spatial stereo sound with the mixing device, wherein the generating of the first and second channel signals comprises generating the first and second channel signals by applying a different time delay coefficient having an interaural time difference with respect to different incident angles of each of the reflected sounds.

24. An apparatus to generate a spatial stereo sound, comprising:

a stereo signal generation device to generate stereo signals of first and second channels from a first input channel signal and a second input channel signal, and to generate processed stereo signals of the first and second channels from the first stereo signals of the first and second channels according to a first time difference and a first sound pressure difference;

a surround signal generation device to process one of the first and second input channel signals according to a second time difference and a second sound pressure difference as a first surround signal of the first channel, and to control a phase of the first surround signal of the first channel to generate a second surround signal of the second channel; and a reflected sound processing device to generate reflected signals of the first and second channels based on different delays and different gains, according to a third time difference and a third sound pressure difference for each of the one of the first and second input channel signals that is processed by the surround signal generation device; and a mixing device to add the stereo, processed stereo, surround, and reflected signals of the first and second channels to generate and output a first channel signal and a second channel signal of the spatial stereo sound, wherein the first and second channel signals are generated by applying a different time delay coefficient having an interaural time difference with respect to different incident angles of each of the reflected sounds.

25. The apparatus of claim 24, wherein the mixing device adds the stereo, processed stereo, surround, and reflected signals of the first channel to generate the first channel signal and adds the stereo, processed stereo, surround, and reflected signals of the second channel to generate the second channel signal.

26. The apparatus of claim 24, wherein the surround signal generation device adds the one of the first and second input channel signals that is processed by the surround generation device to the other one of the first and second input channel signals to generate the first surround signal of the first channel and generates the second surround signal of the second channel to have a different phase from the surround signal of the first channel.

27. The apparatus of claim 24, further comprising:

a center channel signal generation device to add the first and second input channel signals to generate a center channel signal of the first and second channels, wherein the mixing device adds the center channel signal to the stereo, processed stereo, surround, and reflected signals of the first and second channels to generate and output the first channel signal and the second channel signal of the spatial stereo sound.

28. The apparatus of claim 24, wherein the third time difference comprises a plurality of time differences;

the third sound pressure comprises a plurality of sound pressure differences; and the reflected sound processing device generates the reflected signals of first and second channels according to the first, second, and third time differences and the first, second, and third sound pressure differences from the one of the first and second input channel signals that are processed by the surround generation device.

29. The apparatus of claim 24, wherein the reflected sound processing device comprises:

a plurality of delay devices to delay the one of the first and second input channel signals that are processed by the surround generation device according to a plurality of different delay time coefficients to generate a plurality of delayed signals;

a feedback device to process the plurality of delayed signals according to the plurality of different time delay coefficients and a plurality of different gains to add the plurality of delay signals to corresponding ones of the plurality of processed delayed signals to generate a plurality of first feedback signals;

a sound image moving filter device to process the plurality of feedback signals according to a plurality of second different time delay coefficients and a plurality of second different gains to generate a plurality of second feedback signals.

30. The apparatus of claim 29, wherein the reflected sound processing device comprises a mixer to mix the plurality of the first feedback signals and the plurality of the second feedback signals to generate the reflected signals of the first and second channels.

31. The apparatus of claim 24, wherein the first, second, and third time differences comprises a time difference of times taken for the respective first and second channels to arrive at two ears.

32. The apparatus of claim 24, wherein the first, second, and third sound pressure differences comprises a sound pressure difference formed between two ears and varying with respect to a frequency or constant.

33. A method of generating a spatial stereo sound, the method comprising:

generating stereo signals of first and second channels from a first input channel signal and a second input channel signal, and generating processed stereo signals of the first and second channels from the first stereo signals of the first and second channels according to a first time difference and a first sound pressure difference with a stereo signal generation device;

processing one of the first and second input channel signals according to a second time difference and a second sound pressure difference as a first surround signal of the first channel, and controlling a phase of the surround signal of the first channel to generate a second surround signal of the second channel with a surround signal generation device; and generating reflected signals of first and second channels based on different delays and different gains according to a third time difference and a third sound pressure difference for each of the one of the first and second input channel signals that is processed according to the second time difference and the second sound pressure difference with a reflected sound processing device; and adding the stereo, processed stereo, surround, and reflected signals of the first and second channels to generate and output a first channel signal and a second channel signal of the spatial stereo sound with a mixing device, wherein the generating of the first and second channel signals comprises generating the first and second channel signals by applying a different time delay coefficient having an interaural time difference with respect to different incident angles of each of the reflected signals.

34. A method of generating a spatial stereo sound, the method comprising:

generating stereo signals of first and second channels from a first input channel signal and a second input channel signal by applying a time difference of times taken for each channel signal to arrive at two ears, and a sound pressure difference formed between the two ears, to each of the first and second input channel signals with a stereo signal generation device;

generating a first and second surround signals with a surround signal generation device;

generating one or more reflected signals of the first and second channels based on different delays and different gains by applying the time difference and the sound pressure difference between the two ears to the first surround signal and the second surround signal with a reflected sound processing device; and adding the generated stereo, surround, and reflected signals of the first channel to generate and output a first channel signal of the spatial stereo sound with a mixing device and adding the generated stereo, surround, and reflected signals of the second channel to generate and output a second channel signal of the spatial stereo sound with the mixing device, wherein the generating of the first and second channel signals comprises generating the first and second channel signals by applying a different time delay coefficient having an interaural time difference with respect to different incident angles of each of the reflected signals.

* * * * *